United States Patent [19]

Schneider

[11] Patent Number: 4,977,017

[45] Date of Patent: Dec. 11, 1990

[54] TAPE FOR TECHNICAL USE

[75] Inventor: Manfred Schneider, Herbrechtingen, Fed. Rep. of Germany

[73] Assignee: Max Schlatterer GmbH & Co. KG, Herbrechtingen, Fed. Rep. of Germany

[21] Appl. No.: 282,030

[22] Filed: Dec. 9, 1988

[30] Foreign Application Priority Data

Dec. 12, 1987 [DE] Fed. Rep. of Germany ..... 3742183

[51] Int. Cl.[5] ..... D03D 15/00; D03D 15/12; D03D 25/00

[52] U.S. Cl. ..... 428/229; 139/420 A; 139/420 B; 428/259; 428/377; 428/395

[58] Field of Search ..... 428/229; 139/420 A, 139/420 B

[56] References Cited

U.S. PATENT DOCUMENTS

| | | | |
|---|---|---|---|
| 4,670,326 | 6/1987 | Heiman | 428/229 |
| 4,724,183 | 2/1988 | Heiman | 428/229 |
| 4,900,613 | 2/1990 | Green | 428/225 |

FOREIGN PATENT DOCUMENTS

| | | |
|---|---|---|
| 1903481 | 7/1964 | Fed. Rep. of Germany . |
| 2640949 | 2/1980 | Fed. Rep. of Germany . |
| 2149048 | 6/1985 | United Kingdom . |

OTHER PUBLICATIONS

"Neue Polymer . . . ", Struktur, Syntheses, Eigenschaften, Verarbeitung.

*Primary Examiner*—James C. Cannon
*Attorney, Agent, or Firm*—Spencer & Frank

[57] ABSTRACT

To permit a woven tape to be used to form cigarettes and filters in cigarette-making machines at least one strand of line fibers and at least one aramid strand, which is made of multifilament aramid fibres, have been twisted together to form a warp thread. This design permits an improvement to tapes for use as a heavy-duty garniture tape, which will meet even very high requirements while for filling the requirements for economical mass production.

8 Claims, 3 Drawing Sheets

TAPE FOR TECHNICAL USE

BACKGROUND OF THE INVENTION

1. Field of the invention

This invention relates to a woven tape for technical purposes, comprising a warp consisting of a single helically wound thread or ply yarn and a weft. The weft can include vegetable fibers and at least one synthetic strand.

2. Description of the Prior Art

In a known woven tape of that kind disclosed in German Utility Model No. 1,903,481 a synthetic strand which has been covered with spun vegetable fibers is used in the warp and in the weft. The threads may be used as single threads or as a ply yarn. The fact that vegetable fibers are spun around the synthetic strand results in the woven tape having the appearance of a tape made only of vegetable fibers, such as cotton, and it has a correspondingly strong adhesion. Owing to the synthetic core strand the tape has a higher tensile strength than a cotton ribbon. In addition, the undesired large elongation of a purely synthetic tape is compensated for by the cotton fibers covering it. It has been found that in spite of the combination of the above-mentioned properties, woven tapes having a warp consisting of ply yarns no longer fulfill the requirements of a garniture tape to be used to form cigarettes and filters in suitable production machines, particularly if the tape is to travel at a speed up to and above 600 m/min. Experiments have shown that in such applications the performance requirements such as stability at elevated temperatures, small elongation, and high tensile strength must not only be increased quantitatively but that they also change proportionately in comparison with those characteristics found at a lower running speed.

A garniture tape is also known for use in cigarette-making machines in which each warp thread consists of a large number of twisted strands made of cotton fibers and the weft threads each has a large number of twisted core strands, each of which has a multifilament synthetic core which is surrounded by a covering made of cotton fibers. That structure is adopted to ensure that the woven tape even when used at high speed in a cigarette-making machine will have a satisfactory working life and will show the best possible consistency of dimensions and a high tensile strength, minimal elongation, and satisfactory dimensional stability with the corresponding frictional properties (German Patent Publication No. 26 40 949).

It is also known that aramid fibers are used in the production of ropes, cables, tubes, belts, and the like, particularly because a relatively large number of aramid structures are available on the market for use in various applications. But such products made of aramid fibers have the disadvantage that the abrasion of fibers is relatively high so that when such fibers were used in garniture tapes the tape would be susceptible to be soiled as result of electrostatic charges (Literature relating to aramid fibers: Elias/Vohwinkel "Neue polymere Werkstoffe für die industrielle Verwendung - Struktur, Synthese, Eigenschaften, Verarbeitung", second series, Hanser Verlag, pages 242 to 255).

SUMMARY OF THE INVENTION

In view of the prior art outlined hereinbefore it is an object of the invention to improve a woven tape of the kind described first above for use as a heavy-duty garniture tape, which not only meets very high demands but also fulfills the requirements for economical mass production.

In accordance with the invention that object is accomplished in that the warp thread comprises at least one strand of linen fibers and at least one strand made from a multiplicity of aramid fibers and such strands have been twisted together. Such a woven tape can be used to shape cigarettes and filters in suitable production machines.

The aramid fiber used in the tape in accordance with the above mentioned invention contains as a fibrous structure a long-chain synthetic polyamide, in which at least 85% of the aramid groups are directly bonded to two aromatic rings. That definition covers also those aramids in which up to 50% of the aramid groups have been replaced by imide groups.

In connection with the teaching set forth hereinbefore it is essential that an aramid strand is twisted together with at least one strand that is made from bast fibers, or preferably of linen fibers. In time-consuming experiments it has been found that certain aramid fibers, perticularly those which consist of polyparaphenylene-3, 4-diphenyletherterephthalamide or polyparaphenyleneterephthalamide, can be twisted together with bast fibers, particularly with linen fibers, in a wet twisting process. In that connection it is particularly important that the elongations of the two combined materials have been shown to be almost the same and lie in a range which is suitable for the making of a composite ply yarn with which the object set forth above can excellently be accomplished. Compared with conventional warp threads of linen, the composite warp thread used in accordance with the invention shows an increase in stabilizing by more than 80% and the tensile strength of the tape at elevated temperatures is increased, on an average, by more than 150%. In addition it is possible to manufacture small yarn diameter as well as its flexibility.

Moreover, the abrasion of fibers and the electrostatic charges will greatly be reduced when aramid fibers are twisted together with bast fibers, preferably linen fibers, in a wet twisting process.

All the results outlined hereinbefore will greatly improve the performance of the tape, the performance ratings of which are larger by a multiple than those of the conventional garniture tapes. In that context it may be pointed out that the large number of structures in which aramid fibers are available will provide a large basis for the selection of aramid fibers which are particularly suitable for the making of the composite ply yarn. That suitability may be influenced by the fact that the molecular structure of some aramids is slightly disturbed by an ether linkage, for instance in polyparaphenylene-3,4-diphenyletherterephthalamide.

In spite of the presence of aramid fibers in the ply yarn, the tape is extremely soft and flexible. That fact will greatly contribute to a more uniform shaping of the cigarette or filter.

DETAILED DESCRIPTION OF THE PREFERRED EMBODIMENT

Figure 1:
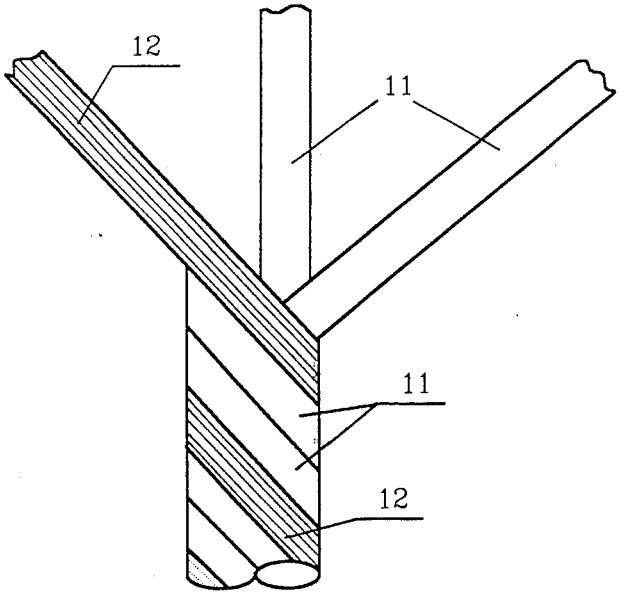
FIG. 1 shows a warp thread in accordance with the invention.
Figure 2:
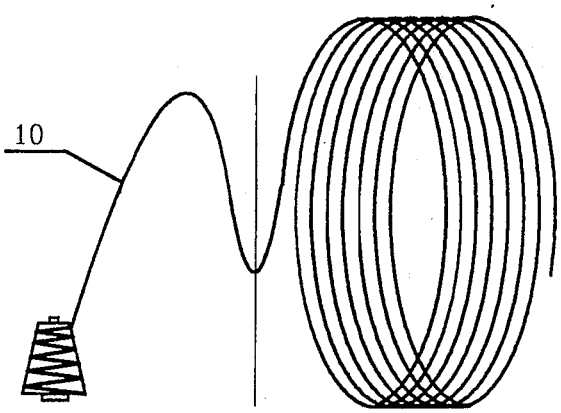
FIG. 2 is a helix constituted by an endless warp composed of consecutive warp threads.

An illustrative embodiment of the invention will now be explained in more detail with reference to the drawing.

The warp threads 10 of a woven tape for technical purposes are constituted by a single helically wound thread. The peripheral length of that helix of consecutive threads 10 will determine the length of the woven tape. The warp threads 10 may constitute ply yarns and consist each of at least one synthetic strand and of vegetable fibers. To permit the tape to be used as a garniture tape to shape cigarettes and filters in corresponding production machines, at least one strand 11 of linen fibers and at least one aramid strand 12, which is made of a multiplicity of aramid fibers, have been twisted together to form each warp thread 10. The aramid fibers of the aramid strand 12 preferably consist of polyparaphenylene-3, 4-diphenyetherterephthalamide or of polyparaphenyleneterephthalamide. By preference a strand 12 formed from aramid fibers, preferably of polyparaphenylene-3, 4-diphenyletherterephthalamide fibers, is twisted together with two strands 11 composed of linen fibers. The weft treads which connect the warp threads are of a twisted core ply yarn, which consists of a synthetic core material and a covering of natural fibers, preferably cotton. In the woven tape, individual aramid fibers of the aramid strand 12 have been deflected and twisted together. Alternatively, the aramid strand 12 may be composed of spun aramid fibers. The ply yarn in accordance with the invention is less brittle than a thread consisting of 100% aramid.

Figure 4:
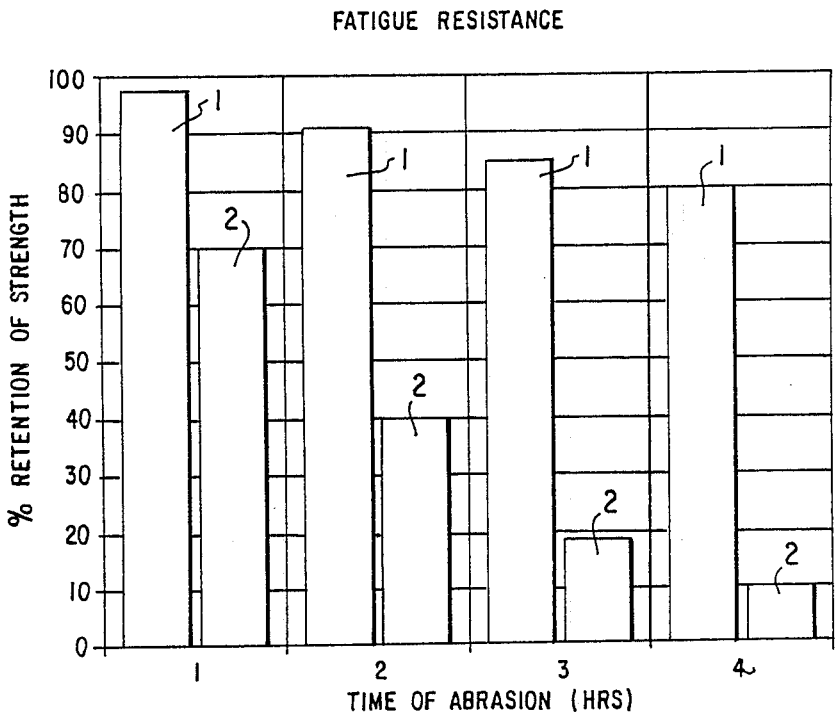
FIG. 4 is a diagram illustrating the fatigue strength.
Figure 3:
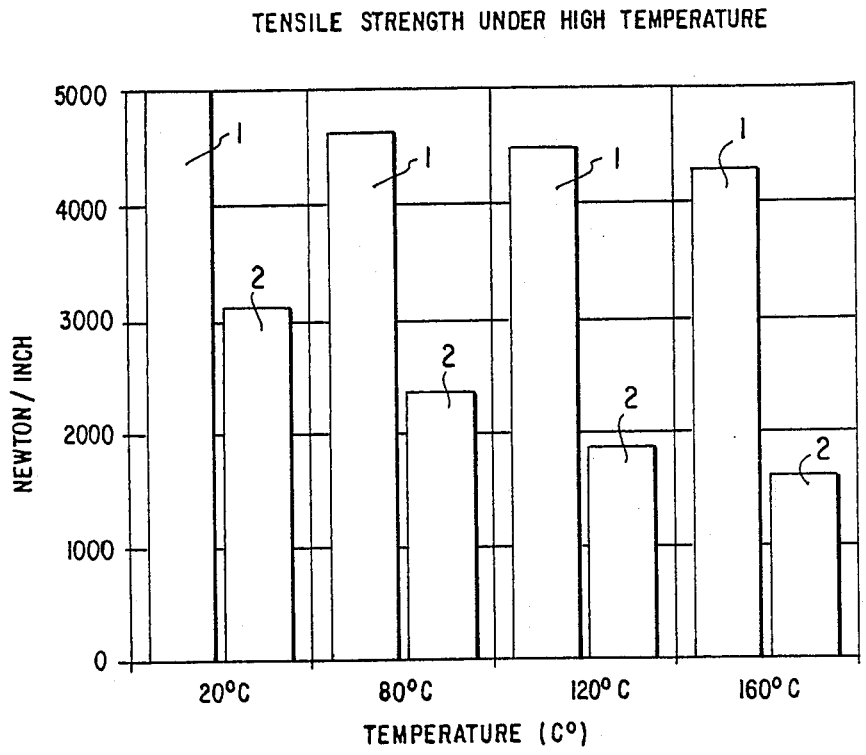
FIG. 3 is a graph on which the teansile strength of the garniture tape in accordance with the invention in various temperature ranges is compared with the tensile strength of a conventional linen garniture tape.

FIG. 3 is a graph in which the tensile strength in N/cm width of the tape is plotted against various operating temperatures of the tape. On an average, the tensile strength of the ribbon is increased by 150%. Particularly at the usual operating temperature of such ribbons, that lies between 120°and 160° C., the tensile strength of the ribbon is higher by more than 200%. In FIGS. 3 and 4, bars '1' correspond to a material consisting of a linen-aramid thread and bars '2' correspond to a ribbon consisting of 100% linen.

In FIG. 4, the fatigue strength as a percent of the initial strength is plotted against time. It is distinctly apparent that the fatigue strength of the tape in accordance with the invention decreases much less with time than the fatigue strength of a conventional ribbon made of 100% linen.

Figure 5:
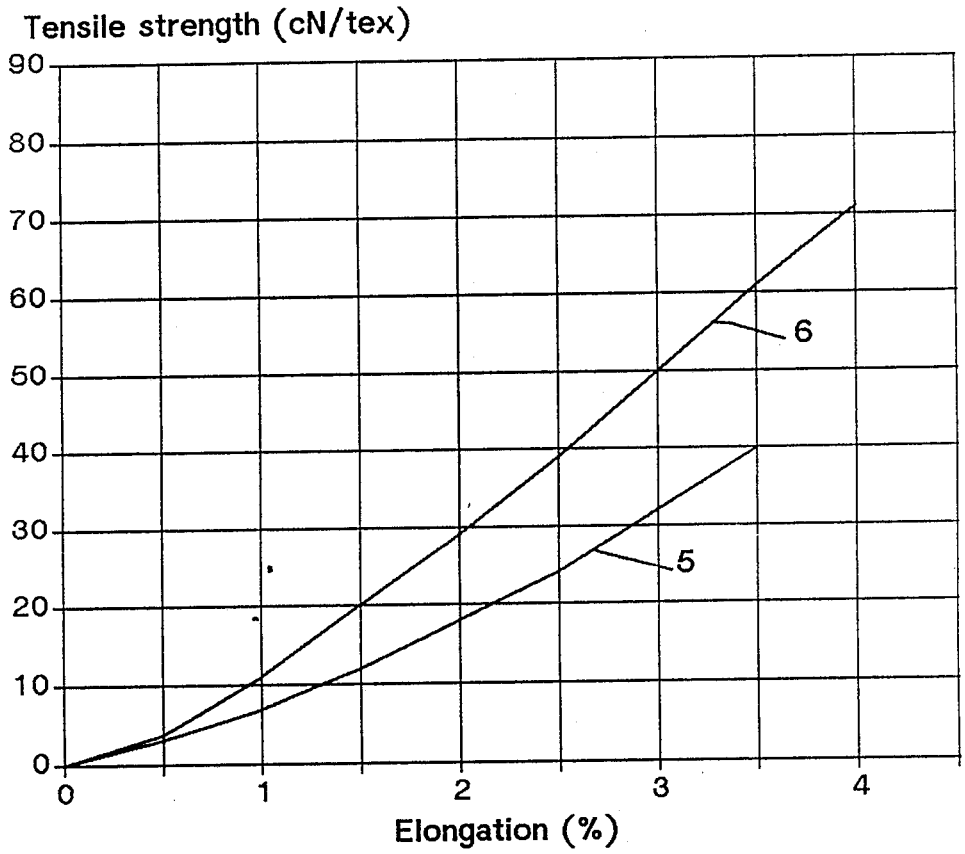
FIG. 5 is a stress-elongation curve.

FIG. 5 is a stress-strain graph, in which a tape 5 of 100% linen is compared with a tape 6 made of linen-aramid. The use of an aramid strand not only increases the tensile stress which results at a given elongation but also results in a higher final strength associated with a somewhat higher final elongation. The possibility of increasing strength, while elongation remains constant, as well as achieving higher final strength, are further advantages afforded by the tape in accordance with the invention. The following conclusions may be drawn from a comparison of the service lives of the garniture tapes compared above:

The garniture tape in accordance with the invention, consisting of 33% polyparaphenylene-3, 4-diphenyletherterephthalamide and 66% linen in the warp and of polyester and cotton in the weft has an average service life of 30 hours. A garniture tape which has a linen warp and a weft like that of the garniture tape in accordance with the invention will have an average service life of 8 hours. Said service lives correspond to a production of 14.4 million and 3.84 million cigarettes, respectively.

The experiments to determine the service life were conducted on a Type Protos SE 80 cigarette-making machine made in 1987 by Körber AG in Hamburg. The experiments were conducted under the following conditions:

8000 cigarettes 72 mm long were made per minute. The tapes moved at a speed of 577 m/min. The tape tension reached up to 500N. The garniture temperature was up to 160° and the heater temperature up to 320° C.

What is claimed is:

1. In a woven tape comprising a helically wound warp thread and a plurality of weft threads;

the improvement wherein:

said warp thread comprises at least one first strand and at least one second strand twisted together;

said at least one first strand substantially consisting of linen fibers; and said at least one second strand substantially consisting of aramid fibers.

2. An article as defined in claim 1, wherein said aramid fibers of said at least one second strand are selected from the group consisting of polyparaphenylene-3, 4-diphenyletherterephthalamide, and polyparaphenyleneterephthalamide fibers.

3. An article as defined in claim 1, wherein said warp thread comprises two first strands.

4. An article as defined in claim 3, wherein said aramid fibers comprise polyparaphenylene-3, 4-diphenyletherterephthalamide fibers.

5. An article as defined in claim 1, wherein said plurality of weft threads includes a core ply yarn having a synthetic core and a covering of natural fibers on said core.

6. An article as defined in claim 1, wherein individual aramid fibers of said at least one second strand are deflected and twisted together.

7. An article as defined in claim 1, wherein said least one second strand comprises multifilament spun aramid fibers.

8. An article as defined in claim 1, wherein said plurality of weft threads includes at least one synthetic material weft thread.

* * * * *